United States Patent [19]

Steel et al.

[11] 4,317,646

[45] Mar. 2, 1982

[54] GAS TURBINE ENGINES

[75] Inventors: Thomas Steel, Littleover; Noel H. Hooke, Etwall; George Pask, Stanton-by-Bridge, all of England

[73] Assignee: Rolls-Royce Limited, London, England

[21] Appl. No.: 123,777

[22] Filed: Feb. 22, 1980

[30] Foreign Application Priority Data

Apr. 26, 1979 [GB] United Kingdom ..... 14606/79

[51] Int. Cl.[3] ..... F01D 11/08

[52] U.S. Cl. ..... 415/116; 415/117; 415/134; 415/172 A; 415/178

[58] Field of Search ..... 415/116, 117, 178, 172 A, 415/134

[56] References Cited

U.S. PATENT DOCUMENTS

| | | | |
|---|---|---|---|
| 2,863,634 | 12/1958 | Chamberlain | 415/134 |
| 3,583,824 | 6/1971 | Smuland | 415/134 |
| 3,825,364 | 7/1974 | Halila | 415/116 |
| 3,864,056 | 2/1975 | Gabriel | 415/116 |
| 4,251,185 | 2/1981 | Karstensen | 415/136 |

FOREIGN PATENT DOCUMENTS

| | | | |
|---|---|---|---|
| 2033021 | 5/1980 | United Kingdom | 415/117 |

*Primary Examiner*—Douglas Hart

*Attorney, Agent, or Firm*—Cushman, Darby & Cushman

[57] ABSTRACT

A device for controlling the clearance between the blade tips of a gas turbine engine turbine rotor and associated segmented shrouds comprises a control ring which is secured to the engine casing by a plurality of dowels. The control ring is supplied with cooling fluid to its hollow interior and is covered with a thermally insulating layer, whereby the rate of movement of the shroud segments can be maintained substantially equal to that of the adjacent turbine rotor.

6 Claims, 3 Drawing Figures

GAS TURBINE ENGINES

This invention relates to gas turbine engines and more particularly to such engines having a turbine rotor of the unshrouded type.

It is well known that in order for an unshrouded type turbine to operate efficiently the clearance between the turbine blade tips and the adjacent casing structure must be maintained within closely defined limits. The difficulties involved in maintaining such clearances have been well known for many years, and the problem has in fact become worse as both the size and working temperatures of gas turbine engines has increased.

One of the main factors which must be taken into account when designing a satisfactory arrangement is matching the respective diameters of the casing and the turbine at the different temperatures encountered during the working cycle of the engine, account must be taken of the differing coefficients of expansion of the materials involved together with the differing stresses imposed upon them, together with their different thermal response rate.

It must also be appreciated that while striving to maintain the smallest possible radial clearance between the respective components the design must be such as to avoid any interference occuring between the respective components during the differing working cycles to which the engine is subjected.

An object of the present invention is to provide a device for controlling the blade radial tip clearance which substantially eliminates the aforementioned problems.

According to the present invention a device for controlling the clearance between the blade tips of a gas turbine rotor and its associated casing structure comprises a hollow annular control ring to which is secured a plurality of shroud segments which surround the blade tips and define the clearance therebetween, the control ring being secured to the engine casing by a plurality of radially extending hollow dowels which are adapted to supply fluid into the interior of the control ring, the ring being covered with a thermally insulating layer whereby the rate of radial movement of the segments can be maintained substantially equal to that of the adjacent bladed turbine rotor which they surround during at least part of the engine operating cycle.

According to a further aspect of the invention the control ring is secured to the outer engine casing by dowels such as to substantially isolate the control ring from any deformation or expansion occuring within the casing.

Furthermore the fluid flow comprises high pressure air bled from the compressor section of the engine, which air is also used to cool the segmented shroud.

Preferably the fluid flow provided to the interior of the control ring may be used to assist in the control of the expansion and contraction of the ring to thereby control the clearance between the segments and the blade tips.

Preferably the thermally insulating layer applied to the control ring comprises a metal foil which defines an insulating air space between the foil and the control ring, alternatively or in addition the insulating layer comprises a refractory material such as for example magnesia stabilized zirconia.

For better understanding of the invention an embodiment thereof will now be more particularly described by way of example only, and as illustrated in the accompanying drawings in which.

Figure 1:
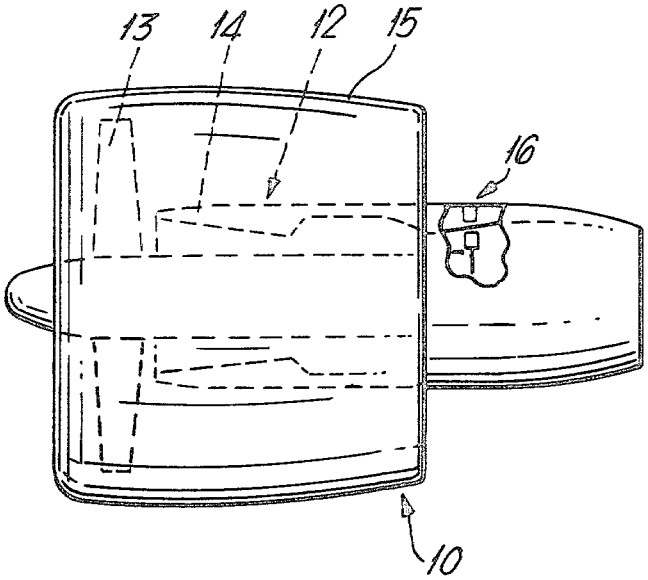
FIG. 1 shows a pictorial view of a ducted fan type gas turbine engine having a broken away portion of its turbine casing disclosing a diagrammatic view of an embodiment of the present invention.

Referring to FIG. 1 of the drawings a ducted fan type gas turbine engine shown generally at 10 includes a main core engine shown generally at 12 which serves to drive a front fan 13 situated within a fan duct which is defined by a portion of the core engine casing 14 and the fan cowling 15. A portion of the core engine casing surrounding the turbine section of the engine shown generally at 16 is broken away, to show a diagrammatic view of one embodiment of the present invention.

Figure 2:
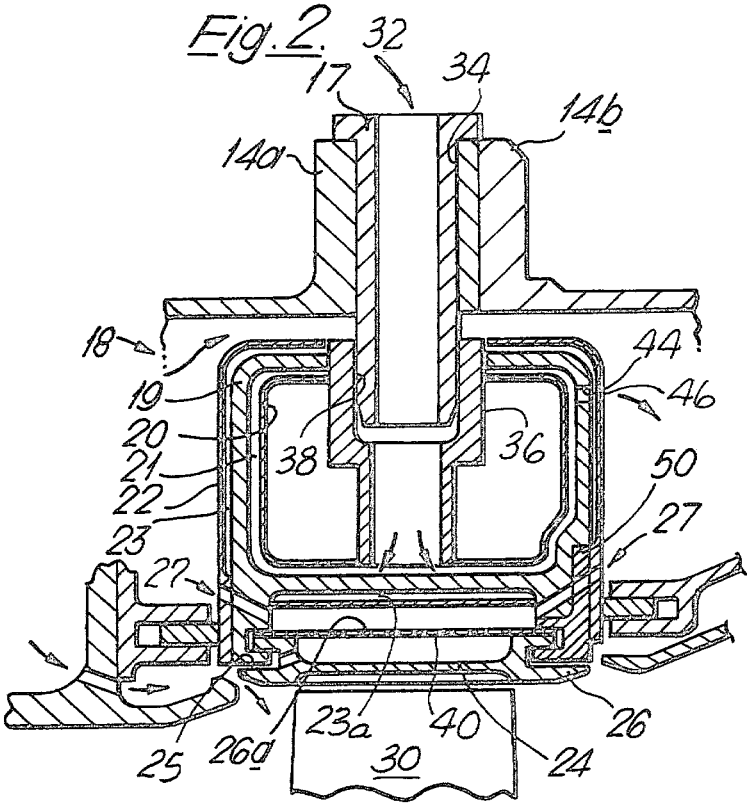
FIG. 2 shows a more detailed cross-sectional view of an enlarged scale of the embodiment shown diagrammatically at FIG. 1.

FIG. 2 of the drawings shows a cross-sectional view in greater detail of the embodiment shown diagrammatically at FIG. 1 and consists of two engine casing portions 14*a* and 14*b* each of which terminate in abutting flanges which are secured together by a plurality of axially extending bolts not shown in the drawings.

As will be seen from the drawings the flange on casing portion 14*a* includes locally thickened portions in which are provided with a plurality of circumferentially spaced apart radially extending drillings 34 within each of which is located a hollow dowel one of which is shown at 17. The hollow dowels 17 serve to carry a hollow annular control ring shown generally at 18 which is provided with circumferentially spaced bosses 36 having radial drillings 38 therethrough which correspond with the drillings 34 provided within the flange of casing portion 14*a*. The control ring 18 is located or secured by means of the dowels 17 such that control ring 18 has the ability to expand and contract independently of the casing portions 14*a* and 14*b* and their associated flanges.

The control ring shown generally at 18 comprises a main hollow annular member 19 which is made such that its thermal rate of expansion and contraction closely matches those of the turbine rotor of which one blade 30 is shown. A further annular member 20 is provided within the annular member 19 and is located such as to define a space 21 between the two members 19 and 20 which may be provided with a supply of air through the hollow dowels 17. A metal foil 22 is located over and secured to but can move radially independently of the hollow annular member 19 and is arranged such as to define a space 23 between the two members 19 and 22. A similar space 23*a* is defined between member 19 and a cylindrical member 40. These spaces are filled with air and are sealed such that the air acts as heat insulating material upon the exterior of the annular member 19. However it is envisaged that the space 23 could be filled with some other suitable insulating material, for example asbestos. Alternatively member 22 and space 23 could be entirely eliminated and be replaced by a layer or layers of some suitable ceramic refractory material such as for example magnesium zirconate. Alternatively the space 23 may be utilized to carry the supply of high pressure air from the dowels 17.

Provided radially inwardly of the hollow annular ring member 19 are the segmented shroud portions, one of which is shown at 24. Each shroud portion is provided with axially extending recesses 25 and 26 situated one on either end of the segmental shroud portions 24 by means of which the shroud portions may be secured to the hollow annular ring member 19 by a cooperating portion 42 provided upon the radially innermost end of the annular member 19 and by member 50 which is secured to annular member 19. In this way movement of the shroud segments 24 is limited to the movements of the hollow member 19.

Situated within the annular space defined by the shroud segments 24 and the radially innermost portion of the hollow member 19 is a perforate cylindrical member 26*a* which is provided with a supply of cooling air 27 which passes through the perforate member 26*a* and impinges upon the shroud segments such as to provide them with a degree of cooling. The cooling air 27 is obtained from some suitable location within the compressor section of the core engine.

As previously stated during the operating cycle of a gas turbine engine its components are subjected to changes in both temperature and mechanical stress which changes the tip clearance between the turbine blades 30 and the adjacent shroud segments 24. However, it is believed that by carefully controlling the degree of expansion or contraction to which the ring 19 is subjected, it is possible to maintain the tip clearance within reasonable limits, during critical parts of the engine cycle.

Obviously the engine is designed such that its blade tip clearances are at their minimum size when it is in the cruise condition. However it is also important that the engine is running as efficiently as possible particularly during the 'take-off' and 'climb' engine conditions.

On engine 'start-up' and subsequent 'ground-idle' the turbine blades 30 tend to expand relatively quickly due to both thermal expansion and centrifugal loading, and this tends to close up the radial clearance between the blade tips and the shroud segments 24; however such reduction in clearance can be simply allowed for in the design of the engines by suitable sizing of the relative parts, as it is unimportant if there is an excessively large clearance when the engine is cold and stationary, or during taxi or descent.

When the engine is accelerated to its 'high power' condition for 'take off' and 'climb' the turbine blades undergo a further expansion which is caused by both centrifugal force, and thermal expansion. However expansion also occurs in the turbine discs which increase in diameter, due to both thermal expansion and centrifugal force. During this time the shrouds and casing undergo some expansion due to thermal effects and pressure. However such expansion would not prove to be so sufficient to maintain an adequate tip clearance without the provision of the hollow annular control ring structure 18.

Matching the respective growth rates of the turbine shrouds 24 to that of the turbine blades so as to maintain an acceptable tip clearance during the 'take-off' and 'climb' mode of the engine cycle is achieved by matching the rate of expansion of the control ring 19 to that of the turbine rotor disc and blade structure.

Such matching is achieved by providing the hollow annular ring member 19 with a thermally insulating barrier comprising the annular member 22 which retains an insulating layer of air in the spaces 23 and 23*a* around the member 19 such that it remains partially isolated from its environment such that its rate of expansion can be matched so as to become similar to that encountered by both the turbine disc and turbine blades during this part of the engine flight cycle. However the rate of expansion or contraction of the hollow annular control ring member 19 may be further controlled by means of a supply of high pressure air 32 which is bled from the compressor section of the engine into the member 19 through the hollow radially extending dowels 17. The high pressure air passes through space 21 and is subsequently exhausted through vents 44 and 46 in members 19 and 22 respectively. Alternatively the high pressure air passes through space 23 and is subsequently exhausted through vents 46 in member 22.

Figure 3:
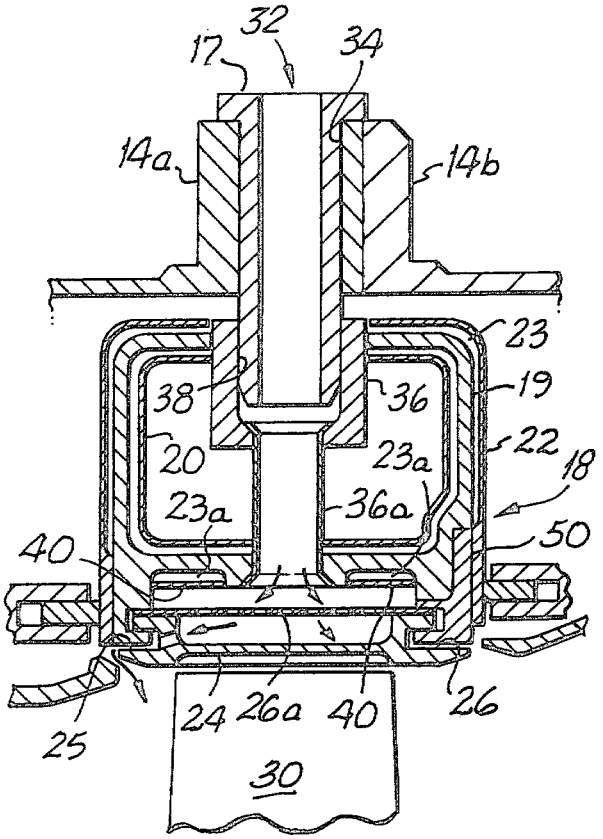
FIG. 3 shows a cross-sectional view of a further embodiment of the present invention.

FIG. 3 shows a further embodiment of the present invention, however in this case the air supply 32 is also used to provide impingement cooling direct to the shroud segments 24 after passing through the control ring structure shown generally at 18. In more detail, the bosses 36 are provided with extensions 36*a* which discharge the air 32 directly into the area above the perforate cylindrical member 26*a*. Air passing through the member 26*a* impinges directly onto the shroud portions 24.

We claim:

1. In a gas turbine engine, the improvement in structure for controlling clearance between blade tips of a turbine rotor having a predetermined rate of expansion and shroud means surrounding the blade tips, the combination comprising:

an engine casing;

a hollow annular control ring concentrically positioned within said casing;

a plurality of shroud segments defining said shroud means about the blade tips of the turbine rotor, said shroud segments being secured to said hollow annular control ring for expansion and contraction with the same;

means operatively supporting said hollow annular control ring and the shroud segments supported thereby from said casing while mechanically isolating said control ring from deformation or expansion of said casing, said support means permitting said control ring to expand and contract independently of said casing while being maintained concentric with the same, and said support means providing means to supply a fluid to the interior of said hollow annular control ring, and means thermally insulating the exterior of said hollow annular control ring, said thermally insulating means and said support means cooperating to control the rate of expansion of said control ring to match the rate of expansion of the turbine rotor whereby clearance between the shroud means and the blade tips of the turbine rotor is a predetermined amount during at least a portion of the operating cycle of the engine.

2. A gas turbine engine as claimed in claim 1 in which the fluid flow comprises high pressure air bled from the compressor section of the engine, which air is also used to cool the shroud segments.

3. A gas turbine engine as claimed in claim 1 in which the thermally insulating means for the exterior of the control ring comprises a metal foil which defines an insulating air space between the foil and the control ring.

4. A gas turbine engine as claimed in claim 1 in which the thermally insulating means for the exterior of the control ring comprises a refractory material extending about the exterior of said control ring.

5. A gas turbine engine as claimed in claim 4 in which the refractory material comprises magnesia stabilized zirconia.

6. A gas turbine engine as claimed in any one of claims 1, 2, 3, 4 or 5 in which said support means for said control ring includes a plurality of circumferentially spaced hollow dowels extending radially through said casing and received in a plurality of radially extending drillings in said hollow annular control ring, said supply fluid to the interior of said control means being supplied through said hollow dowels.

* * * * *